US006559585B2

(12) United States Patent
Murai et al.

(10) Patent No.: US 6,559,585 B2
(45) Date of Patent: May 6, 2003

(54) COLOR CATHODE RAY TUBE

(75) Inventors: Takashi Murai, Fukaya (JP); Shinichiro Nakagawa, Fukaya (JP); Yoshiaki Ito, Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 145 days.

(21) Appl. No.: 09/863,473

(22) Filed: May 24, 2001

(65) Prior Publication Data

US 2001/0052745 A1 Dec. 20, 2001

(30) Foreign Application Priority Data

May 26, 2000 (JP) ..... 2000-157061

(51) Int. Cl.[7] ..... H01J 29/80
(52) U.S. Cl. ..... 313/402; 313/404; 313/407
(58) Field of Search ..... 313/402, 404, 313/407, 403, 405, 406, 408

(56) References Cited

U.S. PATENT DOCUMENTS 3,808,493 A * 4/1974 Kawamura et al. ..... 313/402
6,259,194 B1 * 7/2001 Ito et al. ..... 313/408
6,323,589 B1 * 11/2001 Inoue et al. ..... 313/402
6,384,522 B1 * 5/2002 Tani et al. ..... 313/402

FOREIGN PATENT DOCUMENTS

JP 8-50860 2/1996
JP 8-293266 11/1996

* cited by examiner

*Primary Examiner*—Sandra O'Shea
*Assistant Examiner*—Bao Truong
(74) *Attorney, Agent, or Firm*—Oblon, Spivak, McClelland, Maier & Neustadt, P.C.

(57) ABSTRACT

A shadow mask includes a mask body having a principal mask surface with electron beam passage apertures, a skirt portion, and long and short axes, and a mask frame attached to outside the skirt portion. The mask frame has a coefficient of thermal expansion higher than that of the mask body. The skirt portion includes first and second tongue portions situated on the short and long axes, respectively. Each of the first and second tongue portions is fixed to the mask frame. The mask body is formed to fulfill relations given by $(Ca \cdot Wb) < (Cb \cdot Wa)$, and $V < H$, where Ca and Wa are the length and width of the first tongue portion, respectively, Cb and Wb are the length and width of the second tongue portion, respectively, H and V are the length of the principal mask surface in the directions of the long and short axes, respectively.

13 Claims, 4 Drawing Sheets

COLOR CATHODE RAY TUBE

CROSS-REFERENCE TO RELATED APPLICATIONS

This application is based upon and claims the benefit of priority from the prior Japanese Patent Application No. 2000-157061, filed May 26, 2000, the entire contents of which are incorporated herein by reference.

BACKGROUND OF THE INVENTION

The present invention relates to a color cathode ray tube provided with a shadow mask.

In general, a color cathode ray tube comprises a vacuum envelope that includes a panel and a funnel. The panel includes a substantially rectangular effective portion having curved inner and outer surfaces and a skirt portion that is set up on the periphery of the effective portion. The funnel is bonded to the skirt portion. A substantially rectangular phosphor screen is provided on the inner surface of the panel effective portion. The phosphor screen includes black non-luminous layers and three-color phosphor layers that are embedded in gaps between the non-luminous layers and glow blue, green, and red, individually. Further, a substantially rectangular shadow mask is opposed to the phosphor screen. On the other hand, an electron gun for accelerating, focusing, and emitting three electron beams is located in a neck of the funnel.

In the color cathode ray tube constructed in this manner, the three electron beams emitted from the electron gun are deflected by means of magnetic fields, that are generated by a deflecting yoke mounted on the outside of the funnel, so as to horizontally and vertically scan the phosphor screen through the shadow mask, whereupon a color image is displayed.

The shadow mask is provided with a mask body and a mask frame. The mask body includes a substantially rectangular principal mask surface that is formed of a curved surface opposed to the phosphor screen and a skirt portion that is formed by bending the peripheral edge portion of the principal surface. A large number of electron beam passage apertures are formed in the principal mask surface and arranged at given pitches. The mask frame is welded to the skirt portion of the mask body. The electron beam passage apertures of the mask body serve to screen the electron beams that are landed on the three-color phosphor layers.

In order to display an image free from color drift on the phosphor screen, the electron beam passage apertures of the mask body and their corresponding phosphor layers must be kept in specific relative positions. During the operation of the color cathode ray tube, the positional relations between the electron beam passage apertures and the phosphor layers, especially the distance (value q) between the principal mask surface of the mask body and the inner surface of the panel, must be kept within a given allowable range.

On the other hand, the electron beams that pass through their corresponding electron beam passage apertures and reach the phosphor screen during the operation of the color cathode ray tube account for ⅓ or less of all the electron beams that are emitted from the electron gun. The remaining electron beams run against some other portions of the mask body than the electron beam passage apertures and are converted into thermal energy, thereby heating the mask body. As the mask body is heated in this manner, it undergoes thermal expansion, whereupon so-called doming occurs such that the mask body bulges toward the phosphor screen. If this doming causes the distance between the principal mask surface of the mask body and the inner surface of the panel to exceed the given allowable range, the positions in which the electron beams are landed on the phosphor layers shift, so that the color purity lowers. This shift of landing of the electron beams on the phosphor layers substantially varies depending on the luminance or duration of image patterns.

As modern color cathode ray tubes become larger in size, their deflection angles are widened, while their screens are made flatter. In the color cathode ray tubes of this type, the color purity is lowered more drastically by the thermal expansion of the mask body. In many of flat-screen wide-type color cathode ray tubes, Invar (36%—Ni—Fe alloy plate) with a low coefficient of thermal expansion is used for their mask body. In order to avoid an increase in cost of the shadow mask, in this case, a cold-rolled steel plate that is less expensive than Invar is frequently used for the mask frame.

If the mask body and the mask frame are formed of Invar and the cold-rolled steel plate, respectively, however, heat of the mask body that is generated by prolonged operation of the color cathode ray tube is transmitted to the mask frame, so that the mask frame undergoes thermal expansion. Owing to the difference in thermal expansion between the low-expansion mask body and the high-expansion mask frame causes the mask body, in this case, the mask body is pulled and deformed by the mask frame. In a manufacturing process for the color cathode ray tube, moreover, the shadow mask is heated to a higher temperature than by heating that is attributable to the electron beam collision. Accordingly, the difference in thermal expansion between the mask body and the mask frame increases, so that the mask body is deformed considerably.

In order to reduce the deformation of the mask body that is attributable to the difference in thermal expansion between the mask body and the mask frame, there is provided a shadow mask designed so that the skirt portion of the mask body is located inside the mask frame, and tongue portions on the skirt portion are welded to the mask frame. If the mask frame pulls the mask body, with this arrangement, the tongue portions are elastically deformed to absorb the pulling force of the mask frame, thereby reducing the deformation of the principal mask surface.

Although the shadow mask is constructed in this manner, however, it is inevitably large-sized if it is used in a large-sized color cathode ray tube. Thus, the mask body and the mask frame are subject to a substantial difference in elongation that is attributable to the difference in thermal expansion. The pulling force of the mask frame and the extent of the pull increase in proportion to the difference in elongation. In a color cathode ray tube with a flat screen, moreover, the curvature of the principal surface of the mask body is smaller, and its curvature retention strength is smaller than that of a conventional shadow mask. Accordingly, the principal mask surface is inevitably deformed even if the pulling force is small. In the shadow mask of this type, therefore, the pulling force that acts on the principal mask surface should be minimized.

BRIEF SUMMARY OF THE INVENTION

The present invention has been contrived in consideration of these circumstances, and its object is to provide a color cathode ray tube designed so that lowering of the color purity that is attributable to deformation and dislocation of a shadow mask is reduced to improve the image quality.

In order to restrain deformation that is attributable to the difference in thermal expansion between a mask body and a mask frame, it is to be desired that tongue portions of a skirt portion of the mask body should be shaped so that they are as deformable as possible. These tongue portions should be narrow and long.

In this case, however, the tongue portions are liable to be deformed in the crosswise direction, so that the mask body can be dislocated in a direction perpendicular to the tube axis inside the mask frame when it is subjected to a crosswise shock or vibration. In consequence, landing on a phosphor screen shifts, and the color purity lowers. In a phosphor screen forming process, moreover, phosphor layers are exposed with use of a shadow mask as a photo mask, so that attachment to and detachment of the shadow mask from a panel are repeated several times. These attachment and detachment operations cause the mask body to be dislocated, so that the resulting phosphor layers are dislocated, and a desired phosphor screen cannot be formed.

Recently, in particular, there has been an increasing demand for images of higher quality, and the arrangement pitches of the phosphor layers have been narrowed. Thus, the landing allowance for electron beams is so small that more accurate beam landing is required.

Accordingly, a color cathode ray tube according to the present invention comprises: an envelope having a panel including a substantially rectangular effective portion, a tube axis, a long axis perpendicular to the tube axis, and a short axis extending at right angles to the tube axis and the long axis; a phosphor screen formed on the inner surface of the effective portion and including a plurality of phosphor layers; a shadow mask opposed to the phosphor screen in the envelope; and an electron gun located in the envelope, for emitting electron beams to the phosphor screen through the shadow mask.

The shadow mask includes a substantially rectangular mask body having a substantially rectangular principal mask surface opposed to the phosphor screen and formed having a large number of electron beam passage apertures, a skirt portion formed bent around the principal mask surface, and a long axis and a short axis corresponding to the aforesaid long and short axes, respectively, and a substantially rectangular mask frame attached to the skirt portion and situated outside the skirt portion, the mask frame having a coefficient of thermal expansion higher than that of the mask body.

The skirt portion of the mask body includes a first tongue portion situated on the short axis and extending in the direction of the tube axis and a second tongue portion situated on the long axis and extending in the direction of the tube axis, the first and second tongue portions each having a free end portion and being fixed to the mask frame. The mask body is formed so as to fulfill relations given by $$(Ca \cdot Wb) < (Cb \cdot Wa), \text{ and } V < H,$$

where Ca is the length of the first tongue portion in the direction of the tube axis, Wa is the width of the first tongue portion, Cb is the length of the second tongue portion in the direction of the tube axis, Wb is the width of the second tongue portion, H is the length of the principal mask surface in the direction of the long axis, and V is the length in the direction of the short axis.

According to the color cathode ray tube of the invention, moreover, the mask body is formed so as to fulfill a relation given by $$(Ca \cdot Wb)/(Cb \cdot Wa) \leqq V/H.$$

According to the color cathode ray tube of the invention constructed in this manner, the mask body with the low coefficient of thermal expansion is pulled by means of the mask frame with the high coefficient of thermal expansion if the shadow mask is heated. Since the first and second tongue portions on the short and long axes of the skirt portion of the mask body are individually welded to the mask frame, in this case, they are elastically deformed outward when the mask body is pulled by means of the mask frame owing to the difference in thermal expansion between the mask body and the mask frame. Thus, the pulling force that acts on the mask body and the extent of the pull can be absorbed or eased.

The pulling force that acts on the mask body as a result of thermal expansion of the mask frame and the extent of the pull are higher at the long axis end that is more distant from the center of the shadow mask than at the short axis end. Since the second tongue portion on the long axis of the mask body can be elastically deformed more easily and more heavily than the first tongue portion on the short axis, however, it can effectively absorb the pulling force that acts in the direction of the long axis of the mask body and the extent of the pull.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A color cathode ray tube according to an embodiment of the present invention will now be described in detail with respect to the accompanying drawings.

Figure 1:
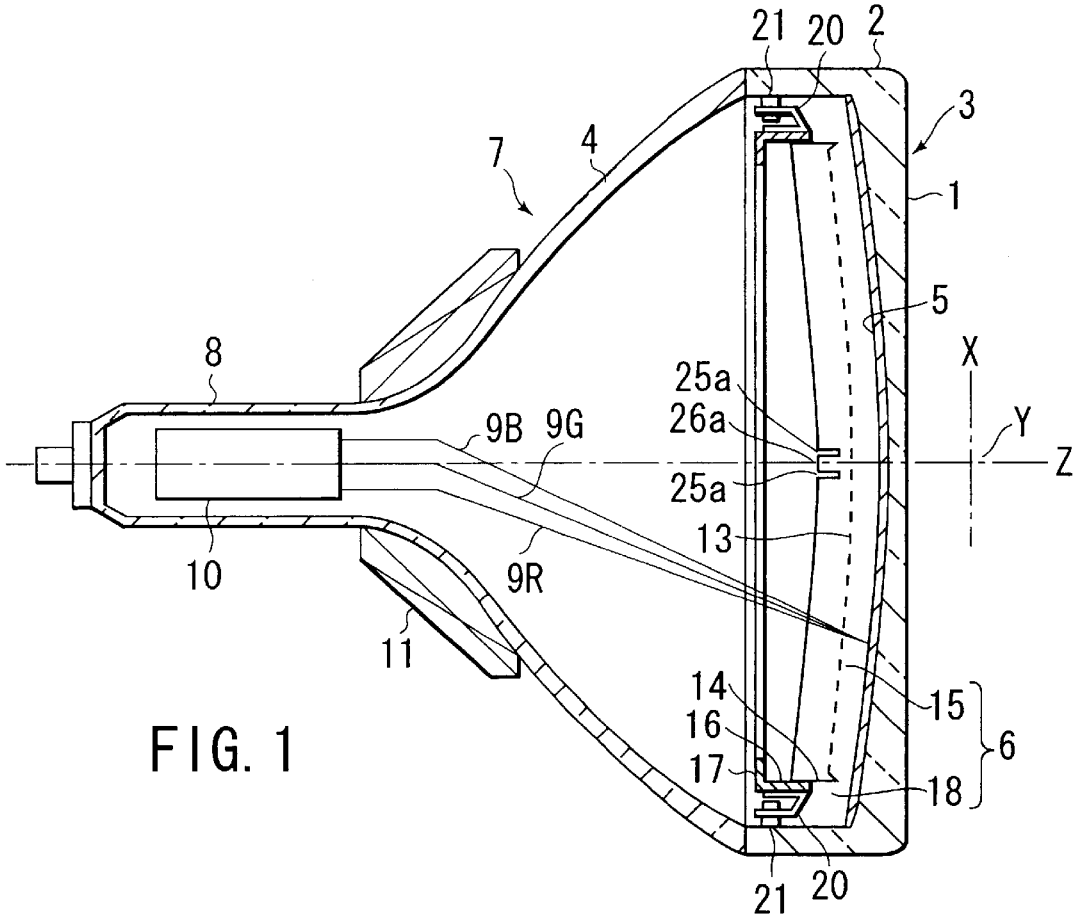
FIG. 1 is a sectional view of a color cathode ray tube according to an embodiment of the present invention.
Figure 2:
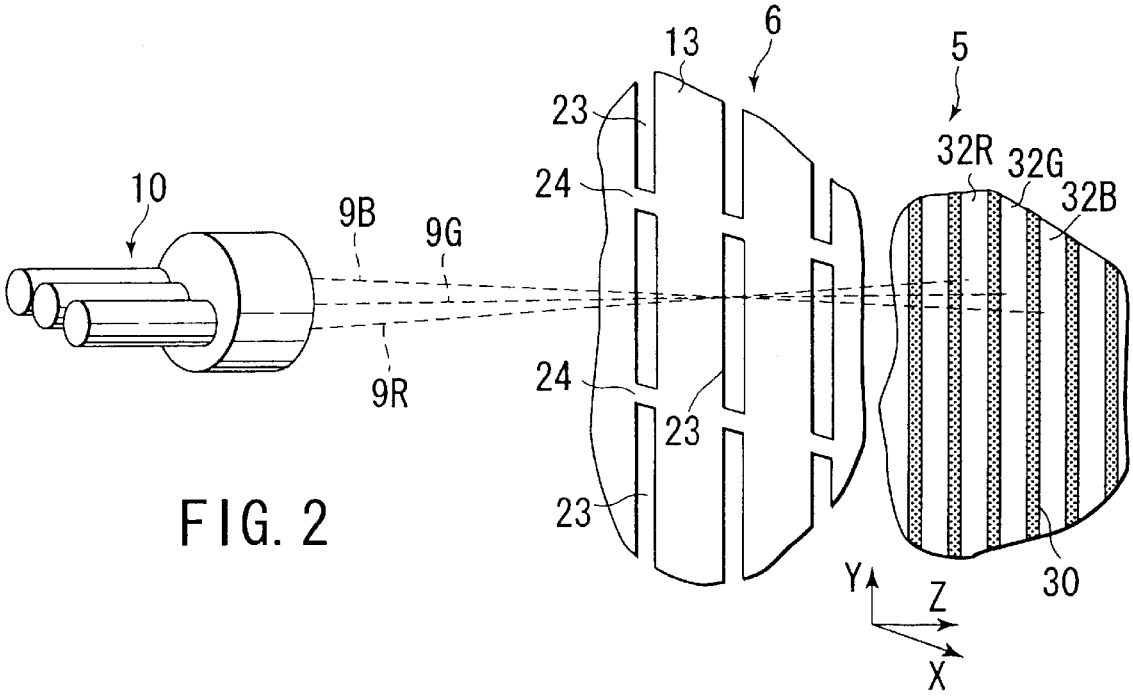
FIG. 2 is a perspective view schematically showing a phosphor screen, shadow mask, and electron gun of the color cathode ray tube.
Figures 3A, 3B, 3C:
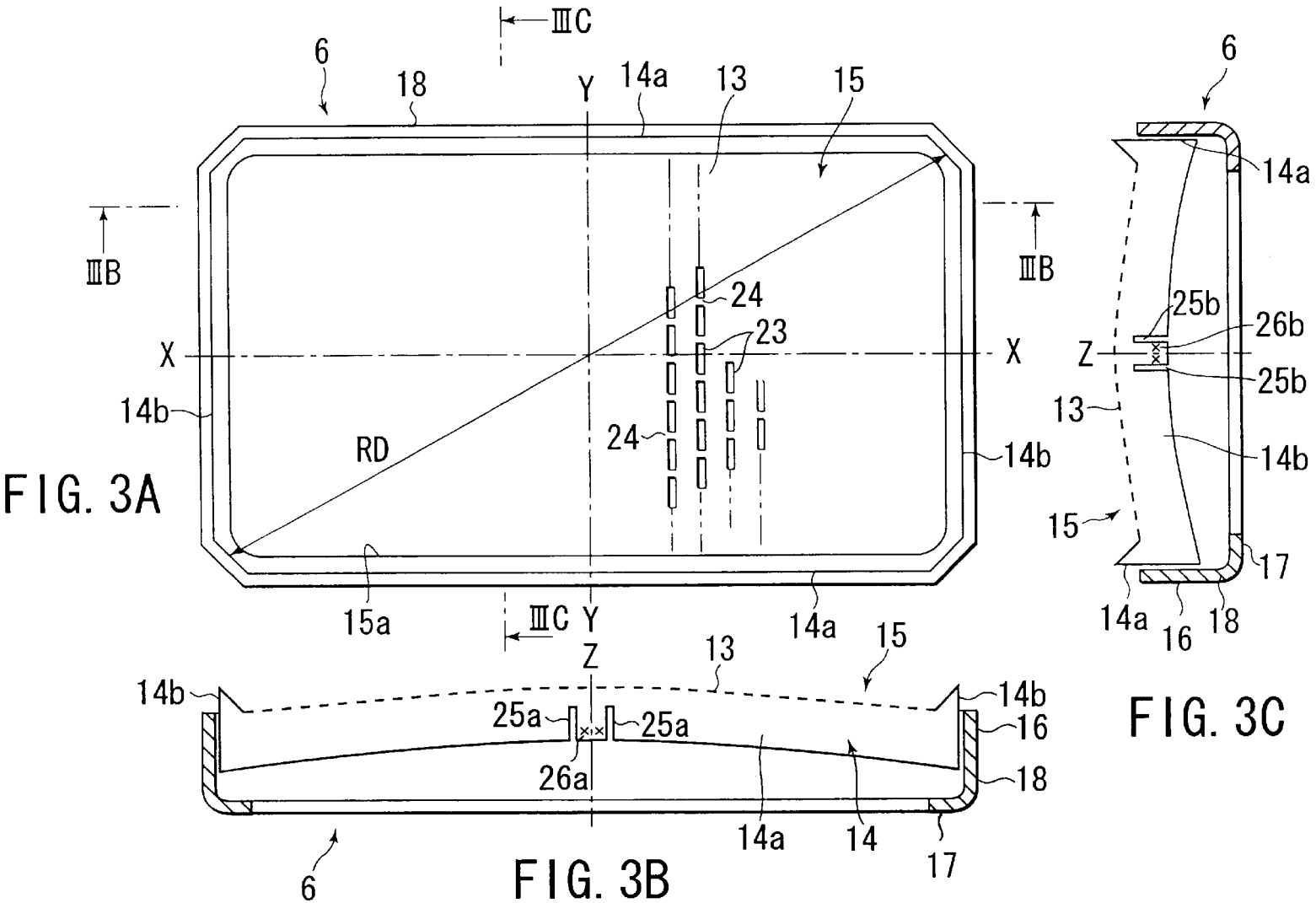
FIG. 3A is a plan view of the shadow mask.
FIG. 3B is a sectional view taken along line IIIB—IIIB of FIG. 3A.
FIG. 3C is a sectional view taken along line IIIC—IIIC of FIG. 3A.
Figure 4:
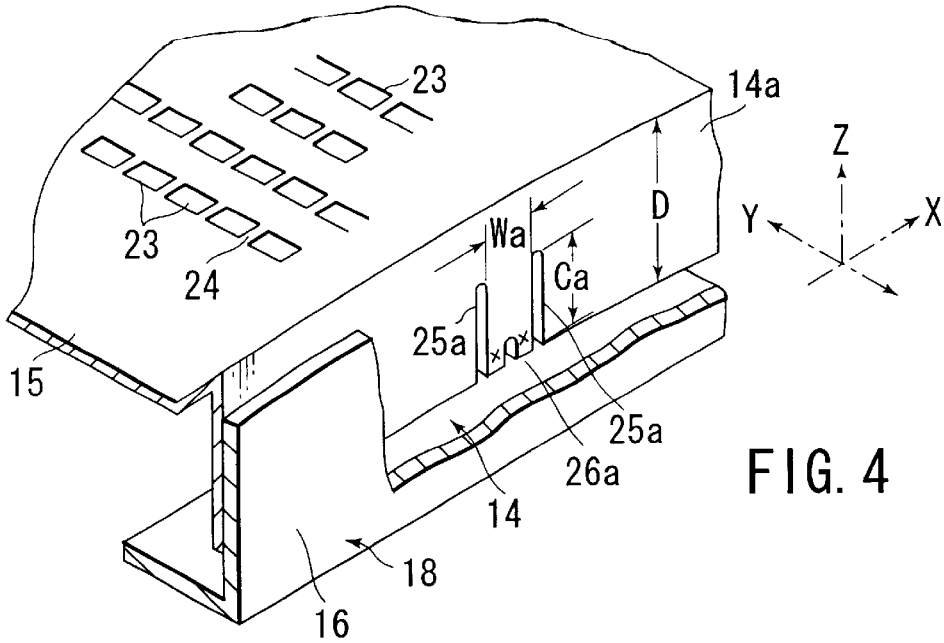
FIG. 4 is a cutaway perspective view of a short-axis end portion of the shadow mask.
Figure 5:
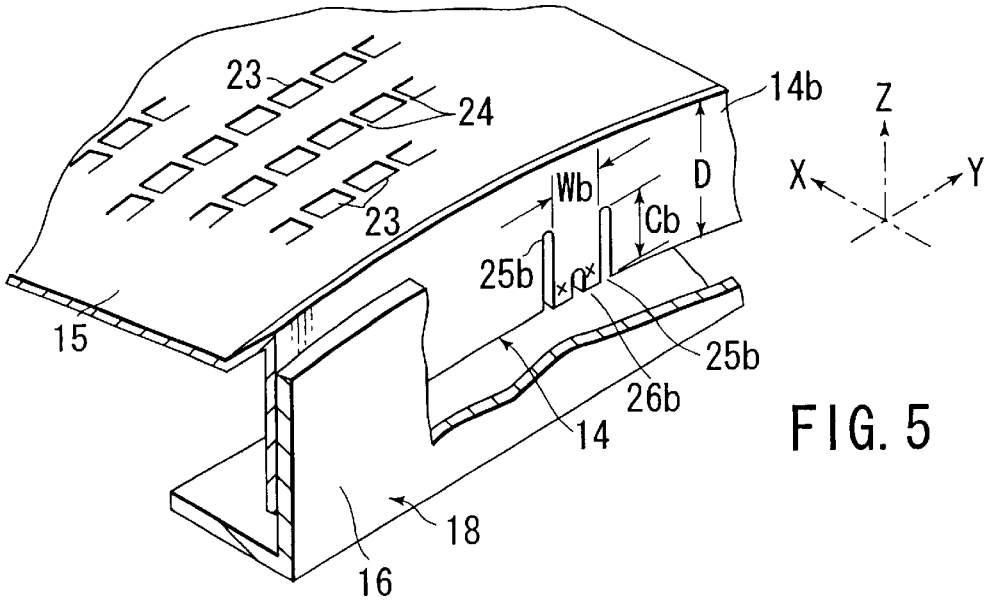
FIG. 5 is a cutaway perspective view of a long-axis end portion of the shadow mask.
Figure 6:
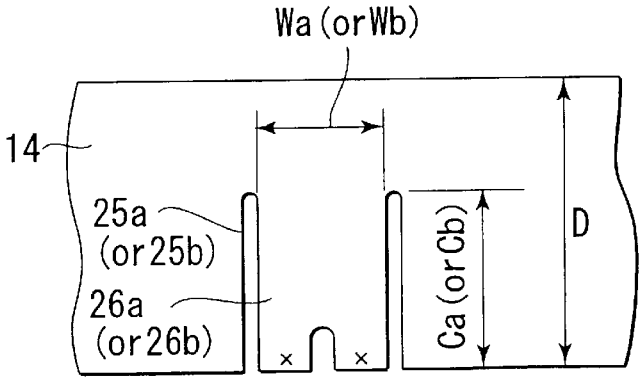
FIG. 6 is a front view showing a tongue portion of the shadow mask.

As shown in FIGS. 1 and 2, the color cathode ray tube comprises a vacuum envelope 7 that includes a panel 3 and a funnel 4. The panel 3 includes a substantially rectangular effective portion 1 and a skirt portion 2 that is set up on the periphery of the effective portion. The funnel 4 is bonded to the skirt portion 2. The outer surface of the panel effective portion 1 is flattened, while the inner surface of the effective portion is in the shape of a curved surface with a small curvature. A cylindrical neck 8 is fixed to a small-diameter end of the funnel 4.

In the vacuum envelope 7, an axis that is coaxial with the panel 3 and extends through the center of the panel 3 is defined as a tube axis Z, an axis that extends in a direction perpendicular to the tube axis as a horizontal axis (long axis) X, and an axis that extends in a direction perpendicular to the tube axis and the horizontal axis as a vertical axis (short axis) Y.

A substantially rectangular phosphor screen 5 is provided on the inner surface of the panel effective portion 1. The phosphor screen 5 includes stripe-shaped black non-luminous layers 30 and stripe-shaped three-color phosphor layers 32R, 32G and 32B that glow red, green, and blue, respectively. The black non-luminous layers 30 individually extend in the direction of the short axis Y and are arranged in parallel with one another in the direction of the long axis X. The phosphor layers 32R, 32G and 32B are embedded in gaps between the non-luminous layers 30, extend in the direction of the short axis Y, and are regularly arranged in parallel with one another in the direction of the long axis X.

Inside the panel 3, a substantially rectangular shadow mask 6 is opposed to the phosphor screen 5. An electron gun 10 for accelerating, converging, and emitting three electron beams 9R, 9G and 9B is located in the neck 8.

In the color cathode ray tube constructed in this manner, the three electron beams 9R, 9G and 9B emitted from the electron gun 10 are deflected by means of magnetic fields, that are generated by a deflecting yoke 11 attached to the outside of the funnel 4, so as to horizontally and vertically scan the phosphor screen 5 through the shadow mask 6, whereupon a color image is displayed.

The shadow mask 6 will now be described in detail. As shown in FIGS. 1 to 3C, the shadow mask 6 is provided with a substantially rectangular mask body 15 and a substantially rectangular mask frame 18 that supports the peripheral edge portion of the mask body. The mask body 15 is formed of Invar material (36%—Ni—Fe alloy plate) with a thickness of about 0.1 to 0.3 mm and a low coefficient of thermal expansion. Further, the mask body 15 includes a rectangular principal mask surface 13 opposed to the phosphor screen 5 and a skirt portion 14 formed bent around the principal surface 13. The principal mask surface 13 is formed of a curved surface that has a curvature corresponding to the inner surface of the panel effective portion 1.

The mask frame 18 includes a side wall opposed to the outer surface of the skirt portion 14 of the mask body 15 and an overhang portion 17 that projects inward from the rear end of the side wall. The frame 18 has an L-shaped cross section. Further, the mask frame 18 is formed of, for example, a cold-rolled steel plate with a thickness of about 0.8 to 2.0 mm and a high coefficient of thermal expansion.

As shown in FIG. 1, the shadow mask 6 is detachably supported inside the panel 3 in a manner such that elastic holders 20 attached to the mask frame 18 are engaged individually with stud pins 21 fixed to the skirt portion 2 of the panel 3.

As shown in FIGS. 1 to 3C, the principal mask surface 13 includes a substantially rectangular effective region 15*a*, which is formed having a large number of slit-like electron beam passage apertures 23. The passage apertures 23 are substantially rectangular, and are arranged in each of lines in the direction of the short axis Y with bridges 24 between them. Electron beam passage aperture rows that are formed of the electron beam passage apertures 23 arranged in the direction of the short axis Y are arranged in parallel with one another in the direction of the long axis X.

As shown in FIGS. 3A to 6, the skirt portion 14 of the mask body 15 includes a pair of long side walls 14*a* extending along the long sides of the principal mask surface 13 and a pair of short side walls 14*b* extending along the short sides of the surface 13. A tongue portion 26*a* is defined on the central portion of each long side wall 14*a* so as to be situated on the short axis Y. Further, a tongue portion 26*b* is defined on the central portion of each short side wall 14*b* so as to be situated on the long axis X. Likewise, a tongue portion (not shown) is formed at each corner of the skirt portion 14.

The tongue portion 26*a* that is provided on each long side wall 14*a* is defined by a pair of notches 25*a* that extend in the direction of the tube axis Z from an open end edge of the skirt portion 14. The paired notches 25*a* extend substantially parallel to each other and have substantially the same length. Each tongue portion 26*a* can be elastically deformed in the direction of the short axis Y substantially around a region that connects the respective extended ends of the paired notches 25*a*.

Each tongue portion 26*a* is welded to the mask frame 18 at two welding points near its free end portion, as indicated by crosses (X). Another notch may be provided between each pair of notches 25*a*, or the two notches 25*a* may be somewhat different in length. The two notches 25*a* may be inclined to the tube axis direction, if they substantially define the tongue portion.

The tongue portion 26*b* that is provided on each short side wall 14*b* is defined by a pair of notches 25*b* that extend in the direction of the tube axis Z from an open end edge of the skirt portion 14. The paired notches 25*b* extend substantially parallel to each other and have substantially the same length. Each tongue portion 26*b* can be elastically deformed in the direction of the long axis X substantially around a region that connects the respective extended ends of the paired notches 25*b*.

Each tongue portion 26*b* is welded to the mask frame 18 at two welding points near its free end portion, as indicated by crosses (X). Another notch may be provided between each pair of notches 25*b*, or the two notches 25*b* may be somewhat different in length. The two notches 25*b* may be inclined to the tube axis direction, if they substantially define the tongue portion.

If the diagonal dimension of the principal mask surface 13 is RD, the width (D) of the skirt portion 14 in the direction of the tube axis Z is set to 2.5% of RD or more. Let it be supposed that the length of each tongue portion 26*a* in the direction of the width D or the length of each notch 25*a* is Ca, the width of each tongue portion 26*a* or the distance between the paired notches 25*a* is Wa, the length of each tongue portion 26*b* in the direction of the width D or the length of each notch 25*b* is Cb, the width of each tongue portion 26*b* is Wb, the length of the principal mask surface 13 in the direction of the long axis X is H, the length in the direction of the short axis Y is V, and the ratio between these lengths is V/H. Thereupon, the tongue portions 26*a* and 26*b* are formed so that there are relations $$(Ca \cdot Wb) < (Cb \cdot Wa), \text{ and } V < H,$$

and preferably, $$(Ca \cdot Wb)/(Cb \cdot Wa) \leqq V/H, \quad (1)$$

where V and H have a relation V<H.

The above relations indicate that the ratio of the ratio Ca/Wa between the length Ca and the width Wa of each tongue portion 26*a* on the short axis Y to the ratio Cb/Wb between the length Cb and the width Wb of each tongue portion 26*b* on the long axis X is not higher than the length ratio V/H of the principal mask surface 13. If Wa=Wb is given, for example, we obtain V/H<1 and hence Cb>Ca. If the tongue portions 26*a* and 26*b* have equal widths, therefore, the length Cb of each tongue portion 26*b* on the long axis X is longer than the length Ca of each tongue portion 26*a* on the short axis Y.

If the respective lengths Ca and Cb of the tongue portions 26*a* and 26*b* are equal (Ca=Cb), we obtain wb<Wa. Thus, the width Wb of each tongue portion 26*b* on the long axis X is shorter than the width Wa of each tongue portion 26*a* on the short axis Y.

Accordingly, each tongue portion 26*b* on the long axis X can be elastically deformed more easily and more heavily than each tongue portion 26*a* on the short axis Y can.

Figure 7A:
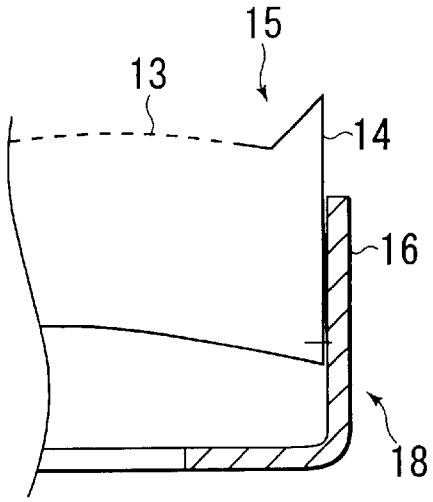
FIGS. 7A and 7B are sectional views schematically showing the relative positions of the tongue portion of the shadow mask and a mask frame.
Figure 7B:
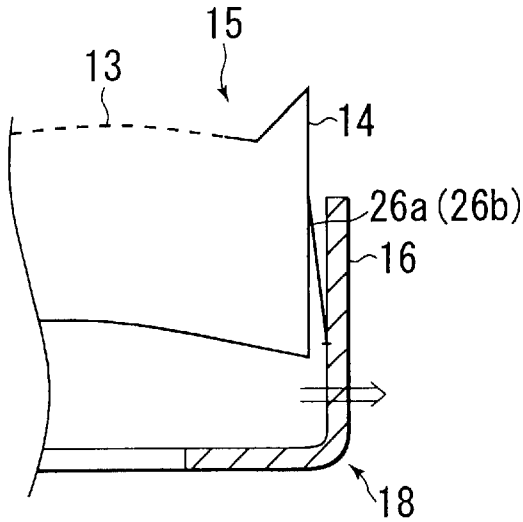

According to the color cathode ray tube constructed in this manner, the mask body 15 with the low coefficient of thermal expansion is pulled by means of the mask frame 18 with the high coefficient of thermal expansion if the shadow mask 6 is heated in a manufacturing process or as it is hit by the electron beams 9R, 9G and 9B during color cathode ray tube operation. Since the tongue portions 26*b* and 26*a* on the long and short axes X and Y of the skirt portion 14 of the mask body 15 are individually welded to the mask frame 18, they are elastically deformed outward when the mask body 15 is pulled by means of the mask frame 18, as shown in FIGS. 7A and 7B. Thus, the pulling force that acts on the mask body 15 and the extent of the pull can be absorbed or eased.

The pulling force that acts on the mask body 15 as a result of thermal expansion of the mask frame 18 and the extent of the pull are higher at the end of the long axis X that is more distant from the center of the shadow mask 6 than at the end of the short axis Y. According to the present embodiment, however, each tongue portion 26*b* at the end of the long axis X of the mask body 15 can be elastically deformed more easily and more heavily than each tongue portion 26*a* at the end of the short axis Y can, so that it can effectively absorb the pulling force that acts on the long-axis end portion of the mask body 15 and the extent of the pull. Thus, the pulling force that acts on the long axis X of the mask body 15 and the extent of the pull can be made equal to or smaller than the pulling force that acts on the short axis Y and the extent of the pull.

On the other hand, the principal mask surface 13 of the mask body 15 is formed having electron beam passage aperture rows that are arranged in parallel with one another in the direction of the long axis X. Each aperture row is formed of a plurality of electron beam passage apertures 23 that are arranged in the direction of the short axis Y with bridges 24 between them. Thus, the curvature retention strength of the mask body 15, especially that of the principal mask surface 13, is higher in the direction of the short axis Y than in the direction of the long axis X, and therefore, the mask body 15 is less deformable in the direction of the short axis Y. If the pulling force that acts in the direction of the short axis Y and the extent of the pull are higher than the pulling force that acts in the direction of the long axis X and the extent of the pull, therefore, deformation of the mask body 15 can be prevented.

Further, crosswise dislocation of the skirt portion 14 of the mask body 15 that is attributable to shock or vibration can be lessened if the respective lengths Ca and Cb of the tongue portions 26*a* and 26*b* are made shorter. If the length Ca of each tongue portion 26*a* on the short axis Y is made shorter than the length Cb of each tongue portion 26*b* on the long axis X, as mentioned before, therefore, dislocation of the mask body 15 in the direction of the long axis X can be lessened. In the case where the phosphor screen 5 is formed of stripe-shaped three-color phosphor layers that are long in the direction of the short axis, the color purity of an image cannot be lowered if the electron beams 9R, 9G and 9B are landed with deviations in the direction of the short axis Y. Thus, the landing allowance in the direction of the short axis Y is generous. However, the landing allowance in the direction of the long axis X is small, so that the color purity lowers if the electron beams are landed with the smallest deviation. With this arrangement, the dislocation of the mask body 15, that is attributable to shock or vibration or repeated attachment and detachment of the shadow mask in a phosphor screen forming process, can be made smaller in the direction of the long axis X than in the direction of the short axis Y. Thus, the resulting color cathode ray tube can enjoy satisfactory color purity.

If the relation of expression (1) is fulfilled, the above-described effects can be obtained equally in the cases of Cb>Ca and Wb<Wa.

The following is a description of an example in which the present embodiment is applied to a wide-type color cathode ray tube with a diagonal dimension of 76 cm.

EXAMPLE 1

The mask body 15 having the skirt portion 14 with the width D of 30 mm was formed from Invar material, and the tongue portions 26*a* and 26*b* with Ca=10 mm, Cb=18 mm, and Wa=Wb=18 mm were formed individually on the open end edge sides of the long and short axis ends of the skirt portion. More specifically, the length Cb of each tongue portion 26*b* at the long axis end was made longer than the length Ca of each tongue portion 26*a* at the short axis end, and the respective widths of these tongue portions are made equal. The mask body 15 was located inside the mask frame 18 that was formed of a cold-rolled steel plate, and each tongue portion was welded to the mask frame.

In the case where the shadow mask constructed in this manner was used, deformation of the mask body attributable to the difference in thermal expansion between the mask body and the mask frame was prevented, and the color cathode ray tube with satisfactory color purity was able to be constructed without the possibility of any substantial dislocation of the mask body attributable to shock or vibration.

EXAMPLE 2

The mask body 15 having the skirt portion 14 with the width D of 30 mm was formed from Invar material, and the tongue portions 26*a* and 26*b* with Ca=Cb=15 mm, Wa=18 mm, and Wb=10 mm were formed individually on the open end edge sides of the long and short axis ends of the skirt portion. More specifically, the width Wb of each tongue portion 26*b* at the long axis end was made narrower than the width Wa of each tongue portion 26*a* at the short axis end, and the respective lengths of these tongue portions are made equal. The mask body 15 was located inside the mask frame 18 that was formed of a cold-rolled steel plate, and each tongue portion was welded to the mask frame.

In the case where the shadow mask constructed in this manner was used, as in the case of Example 1, deformation of the mask body attributable to the difference in thermal expansion between the mask body and the mask frame was prevented, and the color cathode ray tube with satisfactory color purity was able to be constructed without the possibility of any substantial dislocation of the mask body attributable to shock or vibration.

Figure 8:
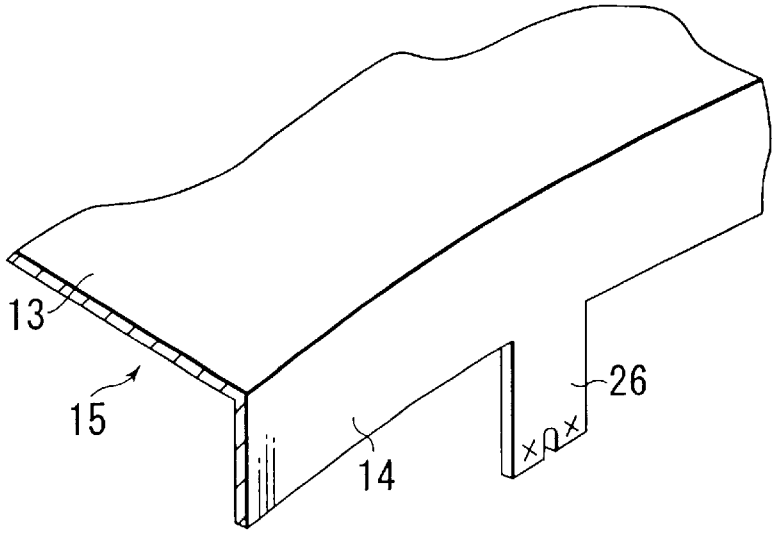
FIG. 8 is a perspective view showing a modification of the tongue portion of the shadow mask.

In the embodiment described above, each tongue portion formed on the skirt portion of the mask body is constructed by forming notches in the skirt portion. Alternatively, however, each tongue portion 26 may be constructed in the form of a projection that extends from an open end edge of the skirt portion 14, as shown in FIG. 8. In this case, the same effects of the foregoing embodiment can be obtained by setting the respective lengths and widths of the tongue portions on the short and long axes of the mask body according to expression (1).

In the wide-type color cathode ray tube according to the foregoing embodiment, the ratio V/H between the short and long axes of the phosphor screen is 9/16. However, the present invention may be applied to a regular color cathode ray tube with V/H of ¾ with the same result.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

an envelope including a panel having a substantially rectangular effective portion, a tube axis, a long axis perpendicular to the tube axis, and a short axis perpendicular to the tube axis and the long axis;

a phosphor screen formed on an inner surface of the effective portion and including a plurality of phosphor layers;

a shadow mask opposed to the phosphor screen in the envelope; and an electron gun located in the envelope, for emitting electron beams to the phosphor screen through the shadow mask, the shadow mask including:

a substantially rectangular mask body having a substantially rectangular principal mask surface opposed to the phosphor screen and formed having a plurality of electron beam passage apertures, a skirt portion formed bent around the principal mask surface, and a long axis and a short axis corresponding to the aforesaid long and short axes, respectively, and a substantially rectangular mask frame attached to the skirt portion and situated outside the skirt portion, the mask frame having a coefficient of thermal expansion higher than that of the mask body, the skirt portion of the mask body including a first tongue portion situated on the short axis and extending in the direction of the tube axis and a second tongue portion situated on the long axis and extending in the direction of the tube axis, the first and second tongue portions each having a free end portion and being fixed to the mask frame, the mask body being formed so as to fulfill relations given by $$(Ca \cdot Wb) < (Cb \cdot Wa), \text{ and } V < H,$$

where Ca is the length of the first tongue portion in the direction of the tube axis, Wa is the width of the first tongue portion, Cb is the length of the second tongue portion in the direction of the tube axis, Wb is the width of the second tongue portion, H is the length of the principal mask surface in the direction of the long axis, and V is the length in the direction of the short axis.

2. A color cathode ray tube according to claim 1, wherein the phosphor layers extend substantially parallel to the short axis;

the electron beam passage apertures are substantially rectangular and are arranged in a plurality of rows, each row including a plurality of electron beam passage apertures arranged in the direction of the short axis with bridges between them, the electron beam passage aperture rows being arranged in parallel with one another in the direction of the long axis.

3. A color cathode ray tube according to claim 1, wherein the mask body is formed so as to fulfill a relation given by $$(Ca \cdot Wb)/(Cb \cdot Wa) \leqq V/H.$$

4. A color cathode ray tube according to claim 3, wherein the electron beam passage apertures are substantially rectangular and are arranged in a plurality of rows, each row including a plurality of electron beam passage apertures arranged in the direction of the short axis with bridges between them, the electron beam passage aperture rows being arranged in parallel with one another in the direction of the long axis.

5. A color cathode ray tube according to claim 1, wherein the first and second tongue portions have relations given by $$Ca = Cb, \text{ and } Wa > Wb.$$

6. A color cathode ray tube according to claim 5, wherein the electron beam passage apertures are substantially rectangular and are arranged in a plurality of rows, each row including a plurality of electron beam passage apertures arranged in the direction of the short axis with bridges between them, the electron beam passage aperture rows being arranged in parallel with one another in the direction of the long axis.

7. A color cathode ray tube according to claim 1, wherein the first and second tongue portions have relations given by $$Wa = Wb, \text{ and } Ca < Cb.$$

8. A color cathode ray tube according to claim 7, wherein the electron beam passage apertures are substantially rectangular and are arranged in a plurality of rows, each row including a plurality of electron beam passage apertures arranged in the direction of the short axis with bridges between them, the electron beam passage aperture rows being arranged in parallel with one another in the direction of the long axis.

9. A color cathode ray tube according to claim 1, wherein the skirt portion includes a pair of first notches extending in the direction of the tube axis from a free end edge of the skirt portion toward the principal mask surface and defining the first tongue portion and a pair of second notches extending in the direction of the tube axis from another free end edge of the skirt portion toward the principal mask surface and defining the second tongue portion.

10. A color cathode ray tube according to claim 9, wherein the electron beam passage apertures are substantially rectangular and are arranged in a plurality of rows, each row including a plurality of electron beam passage apertures arranged in the direction of the short axis with bridges between them, the electron beam passage aperture rows being arranged in parallel with one another in the direction of the long axis.

11. A color cathode ray tube according to claim 1, wherein the skirt portion includes a plurality of projections extending in the direction of the tube axis from a free end edge of the skirt portion and forming the first and second tongue portions, individually.

12. A color cathode ray tube according to claim 11, wherein the electron beam passage apertures are substantially rectangular and are arranged in a plurality of rows, each row including a plurality of electron beam passage apertures arranged in the direction of the short axis with bridges between them, the electron beam passage aperture rows being arranged in parallel with one another in the direction of the long axis.

13. A color cathode ray tube comprising:

an envelope having a panel including a substantially rectangular effective portion, a tube axis, a long axis perpendicular to the tube axis, and a short axis perpendicular to the tube axis and the long axis;

a phosphor screen formed on the inner surface of the effective portion and including a plurality of phosphor layers;

a shadow mask opposed to the phosphor screen in the envelope; and an electron gun located in the envelope, for emitting electron beams to the phosphor screen through the shadow mask, the shadow mask including a substantially rectangular mask body having a substantially rectangular principal mask surface opposed to the phosphor screen and formed having a plurality of electron beam passage apertures, a skirt portion formed bent around the principal mask surface, and a long axis and a short axis corresponding to the aforesaid long and short axes, respectively, and a substantially rectangular mask frame attached to the skirt portion and situated outside the skirt portion, the mask frame having a coefficient of thermal expansion higher than that of the mask body, the skirt portion of the mask body including a first tongue portion situated on the short axis, extending in the direction of the tube axis, and capable of elastic deformation in the direction of the short axis and a second tongue portion situated on the long axis, extending in the direction of the tube axis, and capable of elastic deformation in the direction of the long axis, the first and second tongue portions each having a free end portion and being fixed to the mask frame, the second tongue portion being more easily elastically deformable to a higher degree than the first tongue portion is.

* * * * *